343-700 MS AU 251 EX
10/15/85 OR 4,547,779

United States Patent [19]

Sanford et al.

[11] Patent Number: 4,547,779

[45] Date of Patent: Oct. 15, 1985

[54] ANNULAR SLOT ANTENNA

[75] Inventors: Gary G. Sanford, Boulder; Dean A. Paschen, Lafayette, both of Colo.

[73] Assignee: Ball Corporation, Muncie, Ind.

[21] Appl. No.: 465,486

[22] Filed: Feb. 10, 1983

[51] Int. Cl.[4] ..... H01Q 1/38

[52] U.S. Cl. ..... 343/700 MS

[58] Field of Search ..... 343/700 MS, 829, 846, 343/853

[56] References Cited

U.S. PATENT DOCUMENTS

| | | | |
|---|---|---|---|
| Re. 29,296 | 4/1977 | Krutsinger et al. | 343/700 MS |
| Re. 29,911 | 3/1979 | Munson | 343/700 MS |
| 3,713,162 | 4/1973 | Munson et al. | 343/705 |
| 3,810,183 | 10/1974 | Krutsinger et al. | 343/708 |
| 3,811,128 | 8/1974 | Munson | 343/700 MS |
| 3,921,177 | 7/1975 | Munson | 343/700 MS |
| 3,938,161 | 10/1976 | Sanford | 343/846 |
| 3,971,032 | 7/1976 | Munson et al. | 343/770 |
| 4,012,741 | 9/1977 | Johnson | 343/700 MS |
| 4,051,477 | 7/1977 | Murphy et al. | 343/700 MS |
| 4,070,676 | 5/1978 | Sanford | 343/700 MS |
| 4,131,894 | 4/1978 | Schiavone | 343/700 MS |
| 4,180,817 | 6/1979 | Sanford | 343/700 MS |
| 4,233,607 | 1/1980 | Sanford et al. | 343/700 MS |
| 4,259,670 | 12/1981 | Schiavone | 343/700 MS |
| 4,320,401 | 4/1982 | Schiavone | 343/700 MS |
| 4,460,894 | 7/1984 | Robin et al. | 343/700 MS |

*Primary Examiner*—Eli Lieberman
*Attorney, Agent, or Firm*—Gilbert E. Alberding

[57] ABSTRACT

A microstrip annular antenna structure is formed by four quarter-wavelength microstrip radiator patches arranged in a quadrant formation and having outwardly directed adjacent radiating apertures which together provide a composite annular radiating slot extending about 360° of azimuth. All such radiators are fed in-phase by a single centrally located feedpoint and equal length microstrip transmission lines extending diagonally therefrom to a respective matched impedance feedpoint associated with each radiator patch structure. An extremely low profile rf antenna system results with a monopole or annular slot vertically polarized radiation pattern.

15 Claims, 2 Drawing Figures

ANNULAR SLOT ANTENNA

Figure 1:
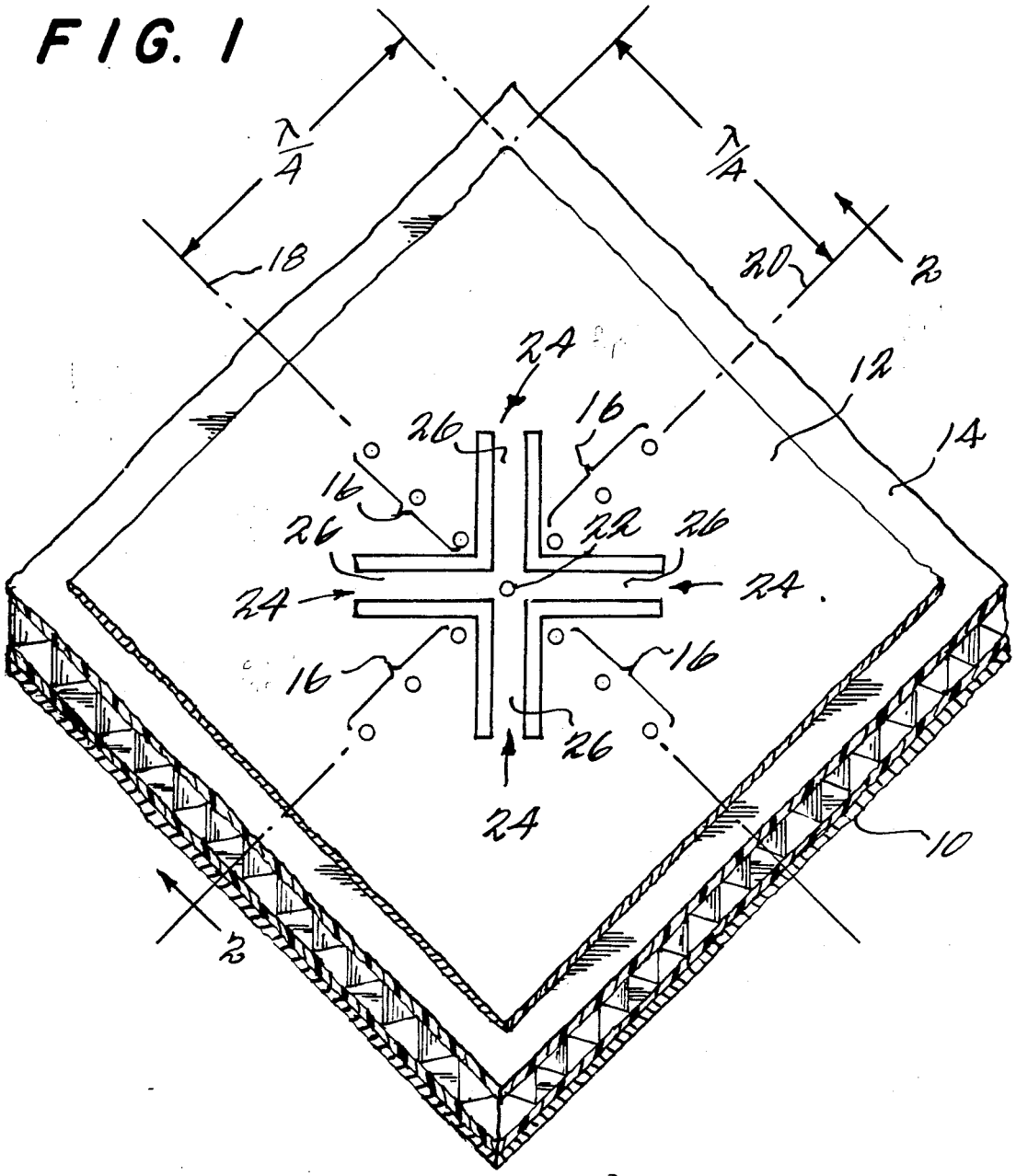

This invention deals generally with annular slot antenna structures and, in particular, with microstrip annular slot antenna structures providing vertically polarized radiation in a monopole or annular slot pattern.

Low profile conformal microstrip radio frequency antenna structures are, in general, now well known in the art. In general, such microstrip antenna structures comprise a shaped radiator "patch" of electrically conductive material suspended (usually by a dielectric layer) at a very short distance above a more extensive electrically conductive ground plane or reference surface. Typically, the shaped radiator patch is spaced considerably less than one-tenth of a wavelength above the ground plane. The height above the ground plane is to some extent determined by the desired operating frequency bandwidth for the antenna structure since somewhat larger bandwidths are provided as the spacing between the patch and the underlying ground plane is increased.

The volume included between the shaped radiator patch and the underlying ground plane can be considered a resonant cavity with one or more radiating slot or apertures defined therein by one or more corresponding edges of the shaped radiator "patch" and the underlying ground plane or reference surface. Such microstrip antenna structures are typically formed by photo-chemically etching the shaped resonantly dimensioned radiator "patch" (and quite commonly associated integrally connected and formed microstrip transmission line structures as well) in an electrically conductive layer bonded to one side of a dielectric sheet. The photo-chemical process used for such selective etching or removal of conductive material may be essentially the same as the selective removal processes used for forming printed circuit boards and the like. The underlying more extensive ground or reference surface is typically formed by a continuous electrically conductive layer bonded to the other side of the dielectric sheet. Honeycomb shaped expanded dielectric structures are also often employed between the ground plane and the radiator patch.

The resulting laminated structure presents an extremely durable and rugged mechanical structure which can nevertheless be easily conformed to curved aerodynamic or other desired shapes while remaining lightweight, etc. These as well as other commonly known attributes of microstrip antenna structures of this type will be appreciated by those skilled in the art. Further information concerning such microstrip antennas may be had by reference to issued U.S. patents commonly assigned with this application such as:

| | |
|---|---|
| U.S. Pat. No. 3,713,162 - Munson et al | (1973) |
| U.S. Pat. No. 3,810,183 - Krutsinger et al | (1974) |
| U.S. Pat. No. 3,811,128 - Munson | (1974) |
| U.S. Pat. No. 3,921,177 - Munson | (1975) |
| U.S. Pat. No. 3,938,161 - Sanford | (1976) |
| U.S. Pat. No. 3,971,032 - Munson et al | (1976) |
| U.S. Pat. No. Re.29,296 - Krutsinger et al | (1977) |
| U.S. Pat. No. 4,012,741 - Johnson | (1977) |
| U.S. Pat. No. 4,051,477 - Murphy et al | (1977) |
| U.S. Pat. No. 4,070,676 - Sanford | (1978) |
| U.S. Pat. No. 4,131,894 - Schiavone | (1978) |
| U.S. Pat. No. Re.29,911 - Munson | (1979) |
| U.S. Pat. No. 4,180,817 - Sanford | (1979) |
| U.S. Pat. No. 4,233,607 - Sanford et al | (1980) |
| U.S. Pat. No. 4,259,670 - Schiavone | (1981) |

-continued

| | |
|---|---|
| U.S. Pat. No. 4,320,401 - Schiavone | (1982) |

There are antenna applications for which a monopole or annular slot pattern (e.g. a "doughnut" shaped radiation pattern covering 360° azimuth about the antenna) of vertically polarized radiation is needed with a low profile antenna of the microstrip type. Typically, in the prior art, such applications have been met by providing a resonantly dimensioned microstrip disc operated in the 3,1 mode. However, since that type of disc is considerably larger than one-half wavelength in diameter (e.g. it is typically of at least one wavelength in at least one dimension), it requires an appreciable surface space. There are antenna applications when sufficient surface space for this type of microstrip annular slot antenna is not available.

However, we have now discovered a microstrip annular slot antenna structure which provides the desired vertically polarized radiation of a monopole or annular slot pattern utilizing a surface area of only approximately one-half wavelength in diameter. This provides the requisite electrical antenna properties in a low profile conformal microstrip antenna structure using as little area as possible.

In addition, the antenna of this invention provides an especially compact and easy to realize r.f. feed structure which easily provides matched impedance feeding between a typical r.f. supply feedline (e.g. 50 ohms) and the antenna structures.

The exemplary embodiment of this invention utilizes a quarter-wavelength resonantly dimensioned single slot microstrip resonant cavity of the type first described in prior issued U.S. Pat. No. 3,713,162—Munson et al. The exemplary embodiment is also easily susceptible to a multiple-frequency vertically stacked arrays of similar antenna structures in the general manner described and claimed in prior issued U.S. Pat. No. 4,070,676—Sanford.

The presently preferred microstrip annular slot antenna structure of this invention is formed by a plurality of adjacently arrayed quarter-wavelength resonant microstrip antenna structures having outwardly directed radiating apertures which together provide a composite annular radiating slot of substantially 360°. A feed network is disposed centrally of such arrayed structures so as to feed commonly phased r.f. energy to/from each of them.

Typically, the microstrip antenna structure of this invention is an overall laminate formed from a dielectric layer initially having electrically conductive surfaces cladded to both sides. A selective photo-chemical etching process is thereafter utilized to selectively remove portions of one of these conductive cladded layers so as to form a substantially square electrically conductive patch surface with each side of such a square being approximately one-half wavelength long (as measured in the dielectric medium at an intended antenna operating frequency). A plurality of electrically conductive connections (e.g. plated through holes or soldered conductive pins) are extended through the dielectric layer and connected both to the patch and the underlying ground plane so as to provide an approximate r.f. short circuit therebetween along two orthogonal lines which therefore divide the volume defined between these conductive surfaces into four approximately quarter-wavelength dimensioned resonant cavities. In the preferred exemplary embodiment, the selective etching process is also utilized to provide four equal length microstrip transmission lines intersecting at a single common feedpoint in the center of the structure and with the microstrip transmission lines each extending diagonally therefrom to a respective matched impedance feedpoint on the surface of the "patch" within an associated one of the quarter-wavelength resonant cavities.

Accordingly, the exemplary embodiment of this invention provides a quadrant array of four quarter-wavelength resonant microstrip antenna structures having outwardly directed radiating apertures which together provide a composite annular radiating slot. A centrally located feed structure is also provided for feeding commonly phased r.f. energy to/from each of the quarter-wavelength resonant microstrip antenna structures.

The composite or arrayed annular aperture structure just described may itself be replicated for operation at a somewhat higher frequency and vertically stacked so as to provide multiple frequency operation where that feature may be desired and where there is sufficient vertical space available for the resulting increased profile antenna structure.

Figure 2:
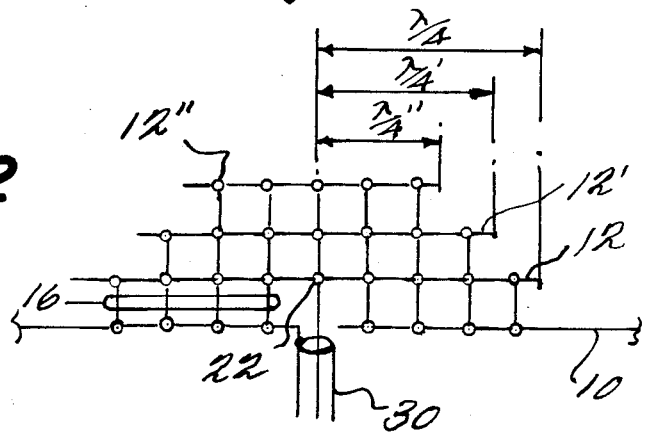

These as well as other objects and advantages of this invention will be more completely understood by careful study of the following detailed description of the presently preferred exemplary embodiment of this invention taken in conjunction with the accompanying drawings, of which:

FIG. 1 is a perspective view of the presently preferred exemplary embodiment of this invention; and FIG. 2 is a schematic sectional view of the embodiment shown in FIG. 1 also including vertically arrayed replicas of the FIG. 1 structure dimensioned so as to provide resonant frequency operation at successively higher radio frequencies.

As mentioned previously, there are many antenna applications where it is desirable or even necessary to provide an antenna structure exhibiting a monopole or annular slot radiation pattern of vertically polarized radiation. A vertically extending monopole is perhaps one readily apparent prior art alternative but it is certainly not a low profile antenna structure. A more conventional annular slot antenna structure requires a relatively thick package (as compared to microstrip antenna structures) and it is more difficult to obtain impedance matching with a feed network with such a conventional annular slot antenna structure. Although a one wavelength microstrip disc operated on the 3,1 mode provides a low profile vertically polarized radiation pattern of the type desired, it requires a substantial surface area.

Now, however, the microstrip annular slot antenna structure shown in FIG. 1 has been discovered to provide the requisite vertically polarized monopole-type radiation pattern with an extremely low profile microstrip antenna type of structure and yet requires a surface area only approximately one-half wavelength in diameter.

As is typical in microstrip antenna structures, a lower ground plane 10 is separated from a shaped resonantly dimensioned radiator patch structure 12 by a dielectric layer 14 (e.g. any of numerous dielectric materials readily available on the market (e.g. Teflon-fiberglass) and conventionally used for microstrip antenna structures which have reasonably low loss characteristics—even air or honeycomb shaped expanded dielectric structures may be utilized if suitable mechanical supports are otherwise provided).

The radiator "patch" 12 is approximately one-half wavelength on each side (as measured in the dielectric medium at the intended operating frequency) and is divided into four quarter-wavelength resonant patches by conductive pins, plated through holes, conductive screws, conductive spacers 16 (or even a solid metal wall if desired) along mutually orthogonal center lines 18 and 20. Although the orientation of center lines 18, 20 shown in FIG. 1 is presently preferred, it might be rotated (e.g. by 45°) from that shown. The resonant dimensions may then be adjusted so as to compensate therefor if necessary to maintain efficient raditation characteristics. In this alternate embodiment each quadrant quarter-wavelength cavity would be of approximately triangular shape.

As will be appreciated, each of the quarter-wavelength resonant cavities is thus provided with top and bottom surfaces of substantially square shape (in the preferred exemplary embodiment) having two adjacent short circuited sides and two adjacent open circuited sides (in the preferred exemplary embodiment) which thereby provide radiation apertures for the cavity. These four cavities are by this arrangement automatically arrayed substantially adjacent one another with the short circuited sides of each cavity defined by the through conductors 16 being adjacent (e.g. in common with) the short circuited sides of two other of the cavities. At the same time, the open circuited sides of all cavities are outwardly directed so as to define a composite square-shaped (in the preferred exemplary embodiment) annular radiation slot defined by the four edges of the overall composite radiator "patch" 12 and the underlying ground or reference plane 10.

A single feedpoint 22 is located centrally at the juncture of the four arrayed quarter-wavelength resonant cavities for feeding commonly phased r.f. energy to/from each of the cavities. Preferably, each individual cavity is fed at a respective feedpoint 24 selected along a diagonal of the center lines 18, 12 of patch 12. The location of the feedpoint along such a diagonal is selected so as to achieve matched impedance feeding.

Diagonally extending microstrip transmission lines 26 are commonly connected at one end to common feedpoint 22 and at the other end to their respective feedpoints 24 within each of the four resonant cavities. The length and impedance of these transmission line segments 26 are chosen so that the individual cavity feedpoint impedances at feedpoints 24 is transformed to four times the desired r.f. connector impedance to be connected and matched at feedpoint 22. As will be appreciated, the parallel connection of these transmission lines at feedpoint 22 will then result in an effective matched impedance at feedpoint 22 with respect to the coaxial cable or other r.f. connector utilized for feeding the overall structure.

The ease with which this antenna structure may thus be matched to the desired feedline impedance (e.g. 50 ohms) also offers a considerable advantage over prior art arrangements. Of course, the extremely low profile conformal structure having an overall size of only approximately one-half wavelength on each side (contained within a surface area of approximately one-half wavelength in diameter) are also considerable advantages of this overall structure.

As will be appreciated by those in the art, the thickness of the dielectric sheet or other structure 14 and thus the separation between the "patch" 12 and the underlying ground plane 10 may be varied so as to control the desired bandwidth of the antenna structure (e.g. thicker antennas have larger operating frequency bandwidths).

It will be noted that the preferred exemplary embodiment provides the bottom surfaces of all the arrayed cavities by a common sheet 10 of electrically conductive material. At the same time, the top surfaces of all the arrayed cavities is provided by a common patch 12 of electrically conductive material. The adjacent short circuited sides of the cavities are provided by a plurality of electrical connections between the top and bottom surfaces along orthogonal lines defining the four arrayed cavities. At the same time, four equal length transmission lines are provided and connected at one end of a predetermined matched impedance feedpoint 24 of a respectively associated cavity top surface and commonly connected at the other ends to a single r.f. feedpoint 22. Typically, the top shaped patch or surface 12 and the bottom ground plane surface 10 are conductive layers cladded to opposite sides of a dielectric substrate 14. The common "patch" 12 and transmission lines 26 are preferably integral connected portions of one of the cladded conductive layers which portions are left intact by selective removal of other portions of that layer.

A schematic cross-sectional view of the FIG. 1 embodiment is shown in FIG. 2 together with optional added structure vertically stacked therewith. The common shaped patch 12, the underlying ground plane 10, the common feedpoint 22 and feed through conductive shorts 16, etc. are depicted in FIG. 2 and believed substantially selfexplanatory in view of the previous description of the FIG. 1 embodiment. The whole arrangement is fed by a coaxial cable 30.

In addition, similar shaped patches 12' and 12'' dimensioned so as to provide resonant cavities of successively higher frequency may be vertically stacked on the FIG. 1 structure as depicted in FIG. 2. The conductive r.f. short circuit connections are merely extended upwardly as indicated in FIG. 2. R.f. feed to individual ones of the vertically stacked structures may be provided by direct connections of a continuing center conductor as depicted in FIG. 2 or by inductive/capacitive coupling effects between patches 12, 12' and 12'' as described in prior issued U.S. Pat. No. 4,070,676—Sanford.

While only a few exemplary embodiments of this invention have been explained in detail, those skilled in the art will appreciate the fact that there are many possible variations and modifications that may be made in these exemplary embodiments while still retaining many of the novel and advantageous features of this invention. Accordingly, all such variations and modifications are intended to be included within the scope of the following claims.

What is claimed is:

1. A microstrip annular slot antenna having a vertically polarized approximately "doughnut" shaped monopole-type radiation pattern comprising:

a plurality of juxtaposed and arrayed quarter-wavelength resonant microstrip antenna structures having outwardly directed radiating apertures which together provide a composite annular radiating slot within an overall area less than the wavelength in its maximum dimension, and feed means disposed centrally of said arrayed structures for radially feeding commonly phased r.f. energy to/from each of said arrayed structures so as to produce said vertically polarized approximately "doughnut" shaped monopole-type radiation pattern.

2. A microstrip annular slot antenna comprising:

a plurality of arrayed quarter-wavelength resonant microstrip antenna structures having outwardly directed radiating apertures which together provide a composite annular radiating slot, and feed means disposed centrally of said arrayed structures for feeding r.f. energy to/from each of said arrayed structures;

wherein said arrayed structures include a dielectric layer having two side surfaces;

an electrically conductive ground or reference surface bonded to one side of said dielectric layer;

a substantially square electrically conductive patch surface bonded to the other side of said dielectric layer with each side thereof being approximately one-half wavelength long in the dielectric at an intended antenna operating frequency; and a plurality of electrically conductive connections extending through said dielectric layer provided at an approximate r.f. short circuit between said patch surface and the underlying reference surface along two orthogonal lines which divide the included volume between said conductive surfaces into four approximately quarter-wavelength dimensioned resonant cavities.

3. A microstrip annular slot antenna as in claim 2 wherein said feed means comprises:

four equal length microstrip transmission lines intersecting at a single common feedpoint and each extending diagonally therefrom to a respective matched-impedance feedpoint on the patch surface within an associated one of said cavities.

4. A microstrip annular slot antenna as in claim 3 wherein said patch surface and said transmission lines are integrally connected portions of a unitary conductive layer left intact by selective removal of portions thereof.

5. A plurality of microstrip annular slot antennas, each said antenna comprising:

a plurality of arrayed quarter-wavelength resonant microstrip antenna structures having outwardly directed radiating apertures which together provide a composite annular radiating slot, and feed means disposed centrally of said arrayed structures for feeding r.f. energy to/from each of said arrayed structures;

each said antenna being dimensioned for operation at different radio frequencies and vertically stacked on top of one another such that the operational frequency of each such successively stacked antenna structure is higher than that of the next underlying structure.

6. A microstrip annular slot antenna having a vertically polarized approximately "doughnut" shaped monopole-type radiation pattern comprising:

a quadrant array of four juxtaposed quarter-wavelength resonant microstrip antenna structures having outwardly directed radiating apertures which together provide a composite annular radiating slot and a maximum cross-array dimension less than one wavelength; and centrally located feed means for radially feeding commonly phased r.f. energy to/from each of said quarter-wavelength resonant microstrip antenna structures so as to produce said vertically polarized approximately "doughnut" shaped monopole-type radiation pattern.

7. A plurality of microstrip slot antennas, each said antenna comprising:

a quadrant array of four quarter-wavelength resonant microstrip antenna structures having outwardly directed radiating apertures which together provide a composite annular radiating slot; and centrally located feed means for feeding commonly phased r.f. energy to/from each of said quarter-wavelength resonant microstrip antenna structures;

each of said antenna being dimensioned for operation at different radio frequencies and vertically stacked on top of one another such that the operational frequency of each such successively stacked antenna structure is higher than that of the next underlying structure.

8. An annular slot antenna structure comprising:

electrically conductive surfaces defining four quarter-wavelength resonant cavities, each having top and bottom surfaces of substantially square shape having two adjacent short circuited sides and two adjacent open circuited sides which thereby provide radiation apertures for the cavity;

said four cavities being arrayed substantially adjacent one another with the short circuited sides of each cavity being adjacent the short circuited sides of two other of said cavities and the open circuited sides of all said cavities being outwardly directed to define a composite square shaped annular radiation slot; and feed means located centrally at the juncture of said four arrayed cavities for feeding commonly phase r.f. energy to/from each of said cavities.

9. An annular slot antenna structure as in claim 8 wherein:

the bottom surfaces of all said arrayed cavities is provided by a common sheet of electrically conductive material; and the top surfaces of all said arrayed cavities is provided by a common patch of electrically conductive material.

10. An annular slot antenna structure as in claim 9 wherein said adjacent short circuited cavity sides are provided by a plurality of electrical connections between said top and bottom surfaces along orthogonal lines defining the four arrayed cavities.

11. An annular slot antenna structure as in claim 10 wherein said feed means comprises four equal length transmission lines each being connected at one end to a predetermined matched impedance feedpoint of a respectively associated cavity top surface and each being commonly connected at their other ends to a single r.f. feedpoint.

12. An annular slot antenna structure as in claim 11 wherein said top and bottom surfaces are conductive layers cladded to opposite sides of a dielectric substrate and wherein said common patch and said transmission lines are integrally connected portions of one of said cladded conductive layers left intact by selective removal of other portions thereof.

13. A plurality of annular slot antenna structures as in claim 8, each being dimensioned for operation at different radio frequencies and vertically stacked on top of one another such that the operational frequency of each such successively stacked antenna structure is higher than that of the next underlying structure.

14. A method of achieving vertically polarized r.f. radiation in a generally monopole "doughnut" shaped radiation pattern comprising the steps of:

arraying a plurality of juxtaposed quarter-wavelength resonant microstrip antenna structures within an area having a maximum dimension less than one wavelength and with outwardly directed radiating apertures which together provide a composite annular radiating slot of substantially 360°, and radially feeding commonly phased r.f. energy to/from each of said arrayed structures from a location disposed centrally thereof so as to produce said vertically polarized generally monopole "doughnut" shaped radiation pattern with a null disposed perpendicular to the arrayed antenna structures.

15. A method of achieving vertically polarized r.f. radiation in a generally monopole "doughnut"-shaped radiation pattern comprising the steps of:

arraying four quarter-wavelength resonant microstrip antenna structures with juxtaposed outwardly directed radiating apertures which together provide a composite annular radiating slot which is square in plan view and of approximately one-half wavelength on each side; and radially feeding commonly phased r.f. energy to/from each of said quarter-wavelength resonant microstrip antenna structures from a location central to all of said structures so as to produce said vertically polarized generally monopole "doughnut" shaped radiation pattern with a null disposed perpendicular to the arrayed antenna structures.

* * * * *